US007857039B2

(12) United States Patent
Nakamura

(10) Patent No.: US 7,857,039 B2
(45) Date of Patent: Dec. 28, 2010

(54) HEAT EXCHANGER

(75) Inventor: Yoichi Nakamura, Nagoya (JP)

(73) Assignee: T. Rad Co., Ltd., Tokyo (JP)

( * ) Notice: Subject to any disclaimer, the term of this patent is extended or adjusted under 35 U.S.C. 154(b) by 712 days.

(21) Appl. No.: 11/795,997

(22) PCT Filed: Dec. 8, 2005

(86) PCT No.: PCT/JP2005/023005

§ 371 (c)(1),
(2), (4) Date: Aug. 29, 2007

(87) PCT Pub. No.: WO2006/080152

PCT Pub. Date: Aug. 3, 2006

(65) Prior Publication Data

US 2008/0164014 A1 Jul. 10, 2008

(30) Foreign Application Priority Data

Jan. 26, 2005 (JP) ..... 2005-018277

(51) Int. Cl.
*F28D 7/10* (2006.01)
*F28D 7/02* (2006.01)

(52) U.S. Cl. ..... 165/157; 165/165

(58) Field of Classification Search ..... 165/157, 165/158, 165, 166, 167, 170, 171, 66, 179
See application file for complete search history.

(56) References Cited

U.S. PATENT DOCUMENTS

| | | | | |
|---|---|---|---|---|
| 3,829,945 | A * | 8/1974 | Kanzler et al. | 29/890.03 |
| 4,384,611 | A * | 5/1983 | Fung | 165/166 |
| 5,282,507 | A * | 2/1994 | Tongu et al. | 165/165 |
| 6,250,380 | B1 * | 6/2001 | Strahle et al. | 165/167 |
| 6,408,941 | B1 * | 6/2002 | Zuo | 165/165 |
| 6,595,274 | B2 * | 7/2003 | Hayashi et al. | 165/158 |
| 6,983,788 | B2 * | 1/2006 | Haglid | 165/54 |
| 2005/0199380 | A1 * | 9/2005 | Thyrum et al. | 165/165 |
| 2006/0048926 | A1 * | 3/2006 | Richter | 165/165 |

FOREIGN PATENT DOCUMENTS

| | | | |
|---|---|---|---|
| JP | 55118598 | A * | 9/1980 |
| JP | 2-133569 | | 11/1990 |
| JP | 2003-90693 | | 3/2003 |
| WO | WO 2004/065876 | | 8/2004 |

* cited by examiner

*Primary Examiner*—Tho V Duong
(74) *Attorney, Agent, or Firm*—Jordan and Hamburg LLP

(57) ABSTRACT

In a heat exchanger used for an EGR cooler or the like, in order to provide a heat exchanger that has a small number of parts, is assembled easily, can flow cooling water evenly at each part, and does not cause partial boiling, a strip-shaped metal plate is turned up and bent in a fanfold manner, flat first flow channels 3 and second flow channels 4 are formed alternately, both the ends of the first flow channels 3 are closed with slit blocks 6, projecting stripes 3*a* are bent and formed at the positions of ports 11 for the cooling water 10 in proximity to the slit blocks 6, and gaps 3*c* are formed between respective paired projecting stripes 3*a*.

6 Claims, 8 Drawing Sheets

HEAT EXCHANGER

BACKGROUND OF THE INVENTION

The present invention relates to a heat exchanger having a simple structure and being easily produced, which can be used as a heat exchanger (EGR cooler) used in an exhaust gas recirculation apparatus of an automobile or another heat exchanger.

A conventional EGR cooler comprises an assembly of a large number of flat tubes or plates, a large number of fins, a casing, and a header, wherein cooling water is made to flow on the side of the casing and an exhaust gas is made to flow in the interior of the flat tubes or the like as the invention disclosed in Japanese Unexamined Patent Publication No. 2003-90693 for example.

The drawbacks of such a heat exchanger as an EGR cooler or the like have been that: the number of parts is large, which makes assembling cumbersome; and the number of brazed portions of each component increases, which causes leakage to tend to occur at the brazed portions. Moreover, it has been feared that the portions where a fluid stagnates may be caused in a flow channel and cooling water may partially come to a boil.

In order to prevent those drawbacks from occurring, in the invention disclosed in the aforementioned Japanese patent publication: a pair of blocking projecting stripes is intermittently provided particularly on the outer surface of a tube at the downstream position of an inlet for cooling water; the cooling water is injected from an inlet pipe and collided with the casing facing the inlet pipe; the reflecting streams are introduced to the projecting stripes and then introduced to an intermediate portion where no stripes exist. The drawbacks thereof have been that the production of such a tube is cumbersome and the cooling water does not flow evenly in each part on a tube surface.

In view of the above situation, an object of the present invention is to provide a heat exchanger that: has a small number of parts; is easy to assemble; has a small number of brazed portions; is highly reliable; can flow cooling water evenly to each part; and does not cause partial boiling.

SUMMARY OF THE INVENTION

The first, broadest aspect of present invention is a heat exchanger wherein:

a core body (5) is configured by turning up and bending a strip-shaped metal plate in a fanfold manner and forming turned-up end edges (1) and (2) alternately at one end and then the other end of a rectangular planar portion (1*a*), and has flat first flow channels (3) and second flow channels (4) alternately in the thickness direction of the metal plate;

the first flow channels (3) of the core body (5) are blocked with slit blocks (6) comprising long boards or bars at both the ends of each of the turned-up end edges (1), flat openings (3*b*) are formed only on one side, fins (7) are interposed in the second flow channels (4), and thus a core (8) is formed;

the outer circumference of the core body (5) is fitted in a tubular casing (9) and thereby communication between adjacent turned-up end edges (1) and (2) is blocked;

a pair of ports (11) for cooling water (10) is formed at both the end portions of the casing (9) on the side facing the side of the openings (3*b*) of the first flow channels (3);

projecting stripes (3*a*) are bent and formed on the opposing planes in each of the first flow channels (3) in proximity to and along the slit blocks (6) at the positions opposing the ports (11), and gaps (3*c*) are formed between the respective projecting stripes (3*a*);

the cooling water (10) is introduced into the respective first flow channels (3) from one of the ports (11), and a part of the introduced cooling water (10) is guided by the projecting stripes (3*a*) and passes through between the pair of opposing projecting stripes (3*a*); and a fluid to be cooled (12) is introduced from one cylindrical opening (13) of the casing (9) to the other opening (13) through the respective second flow channels (4).

According to a second aspect of the invention, a heat exchanger according to the first aspect of the invention is configured so that the gaps (3*c*) between the projecting stripes (3*a*) may vary along the longitudinal direction.

According to a third aspect of the invention, in the heat exchanger according to the second aspect of the invention, the gaps (3*c*) at intermediate portions of the projecting stripes (3*a*) in the longitudinal direction thereof are formed so as to be larger or smaller than the gaps at both the ends.

According to a fourth aspect of the invention, in the heat exchanger according to the first aspect of the invention, the pair of opposing projecting stripes (3*a*) is formed so as to intersect with each other in a plan view.

According to a fifth aspect of the invention, in the heat exchanger according to any one of the first to fourth aspects of the invention, at least both the ends of the projecting stripes (3*a*) in the longitudinal direction thereof curve to the side of the center of each of the first flow channels (3).

According to a sixth aspect of the present invention, the heat exchanger according to any one of the first to fifth aspects of the invention is configured so that the width of each of the projecting stripes (3*a*) may vary along the longitudinal direction thereof.

A heat exchanger according to the present invention is configured as stated above and exhibits the following effects.

A heat exchanger according to the present invention is configured by: building a core 8 with a core body 5 formed by turning up a strip-shaped metal plate in a fanfold manner, slit blocks 6, and fins 7; and fitting the outer circumference of the core 8 in a casing 9. Hence it is possible to provide a heat exchanger having a small number of parts, being produced easily, and having a simple structure at a low cost.

Moreover, the number of joints decreases and air-tightness and liquid-tightness improve, and it is possible to provide a heat exchanger that is compact and excellent in performance. Further, a pair of projecting stripes 3*a* is formed in each of the first flow channels 3 at the ports, thus it is possible to prevent cooling water from stagnating in the vicinity of the ports, then gaps 3*c* are provided between the pair of the projecting stripes 3*a*, therefore the cooling water flows also through the gaps 3*c*, and hence the cooling water flows evenly in each part and the heat exchange is accelerated.

In the above configuration, it is possible to: vary the gaps 3*c* between the projecting stripes 3*a* along the longitudinal direction; and finely adjust the uniform flow of the cooling water in response to various conditions.

Yet further, by configuring the gaps 3*c* at intermediate portions of the projecting stripes 3*a* in the longitudinal direction so as to be larger or smaller than the gaps at both the ends, it is possible to finely adjust the uniform flow of the cooling water in response to various conditions by another method.

Furthermore, by forming the pair of opposing projecting stripes 3*a* so as to intersect with each other in a plan view, it is possible to finely adjust the uniform flow of the cooling water in response to various conditions by yet another method.

In addition, by curving both the ends of the projecting stripes 3*a* in the longitudinal direction thereof on the side of the center of each of the first flow channels, it is possible to smoothen the flow of the cooling water.

Otherwise, by varying the width of each of the projecting stripes 3*a* along the longitudinal direction, it is possible to finely adjust the uniform flow of the cooling water in response to various conditions by another method.

DETAILED DESCRIPTION OF THE INVENTION

Next, embodiments according to the present invention will be described in reference to drawings.

Figure 1:
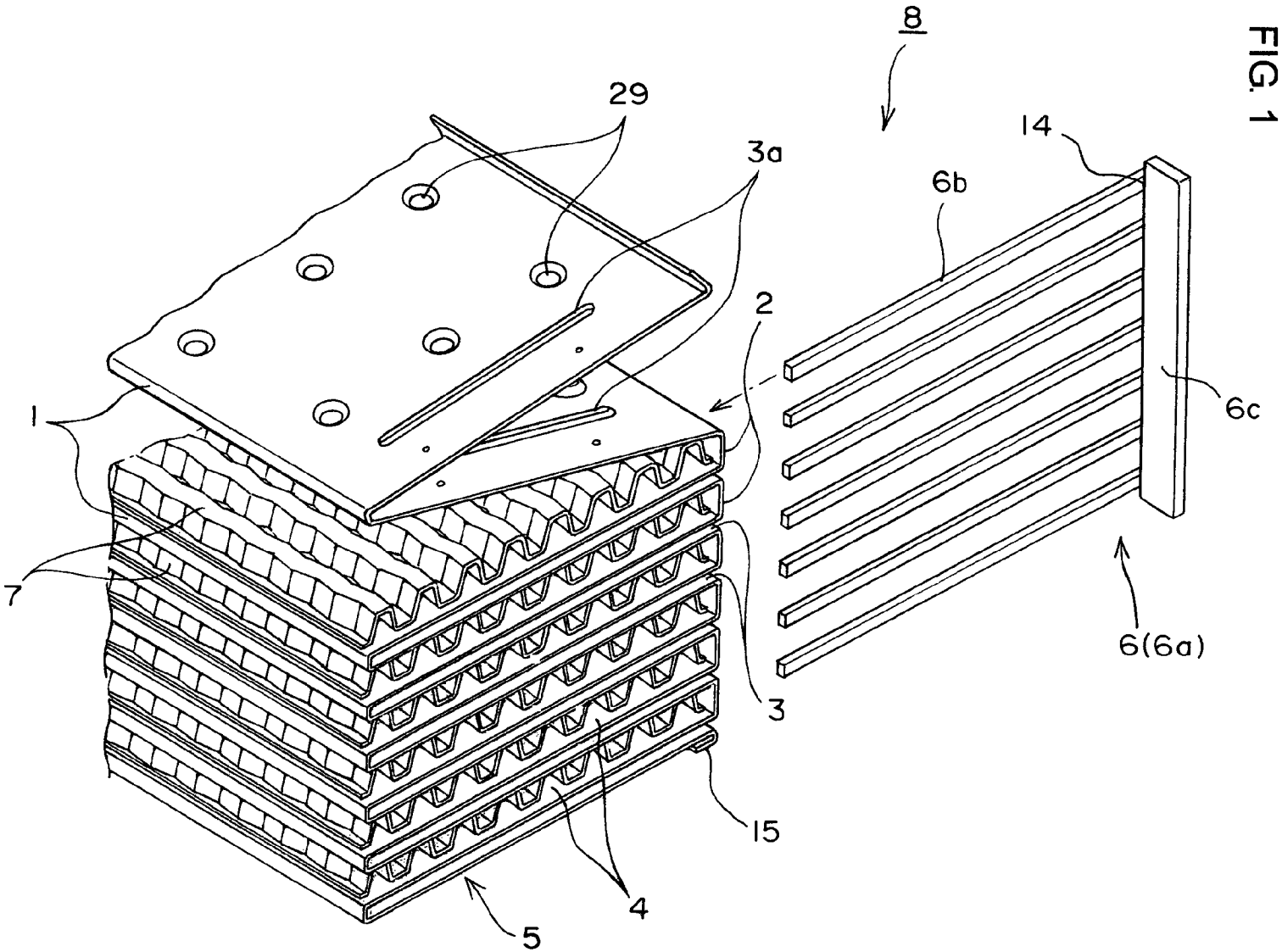
FIG. 1 is an exploded perspective view showing a substantial part of the core section of a heat exchanger according to the present invention.
Figure 2:
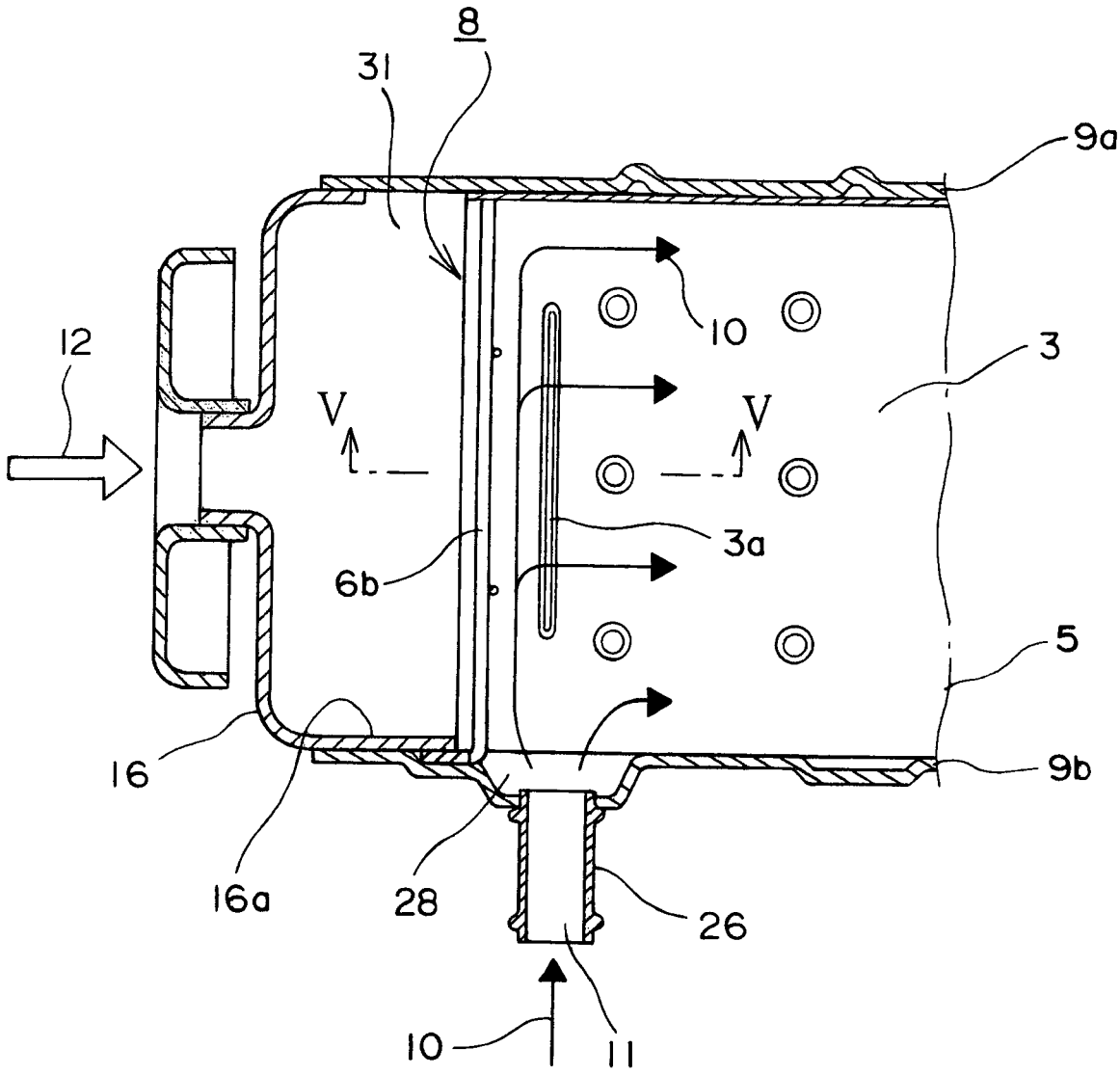
FIG. 2 is a sectional view showing a substantial part of the heat exchanger in the state of assembling.
Figure 3:
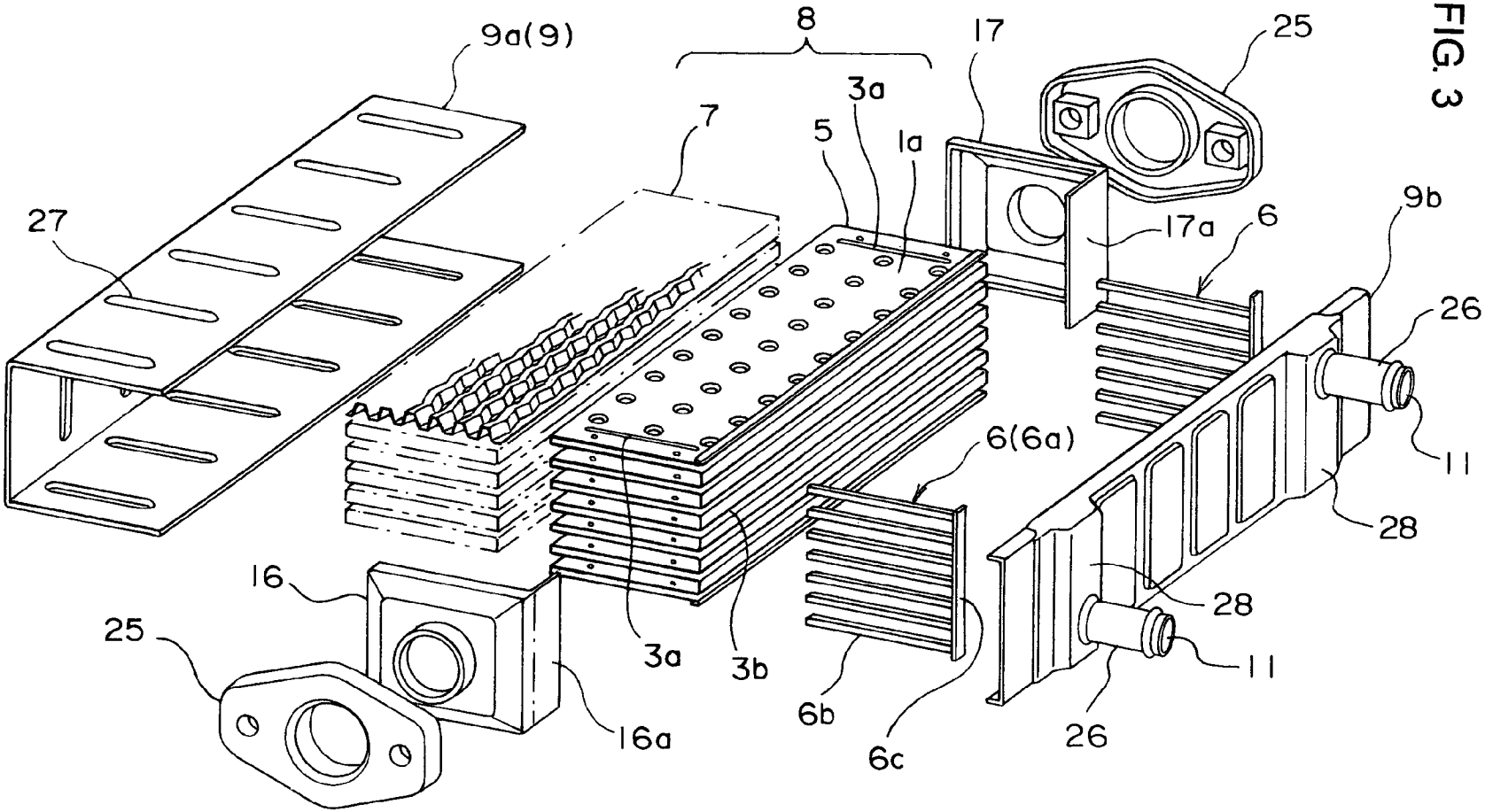
FIG. 3 is an exploded perspective view showing the whole heat exchanger.
Figure 4:
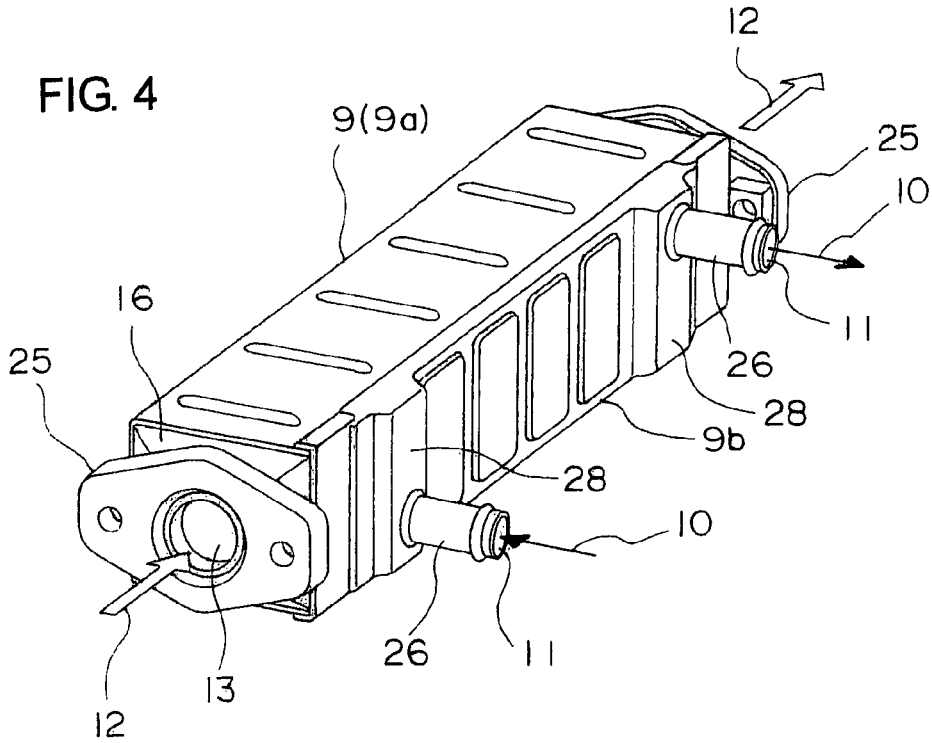
FIG. 4 is a perspective view showing the assembled state of the heat exchanger.
Figure 5:
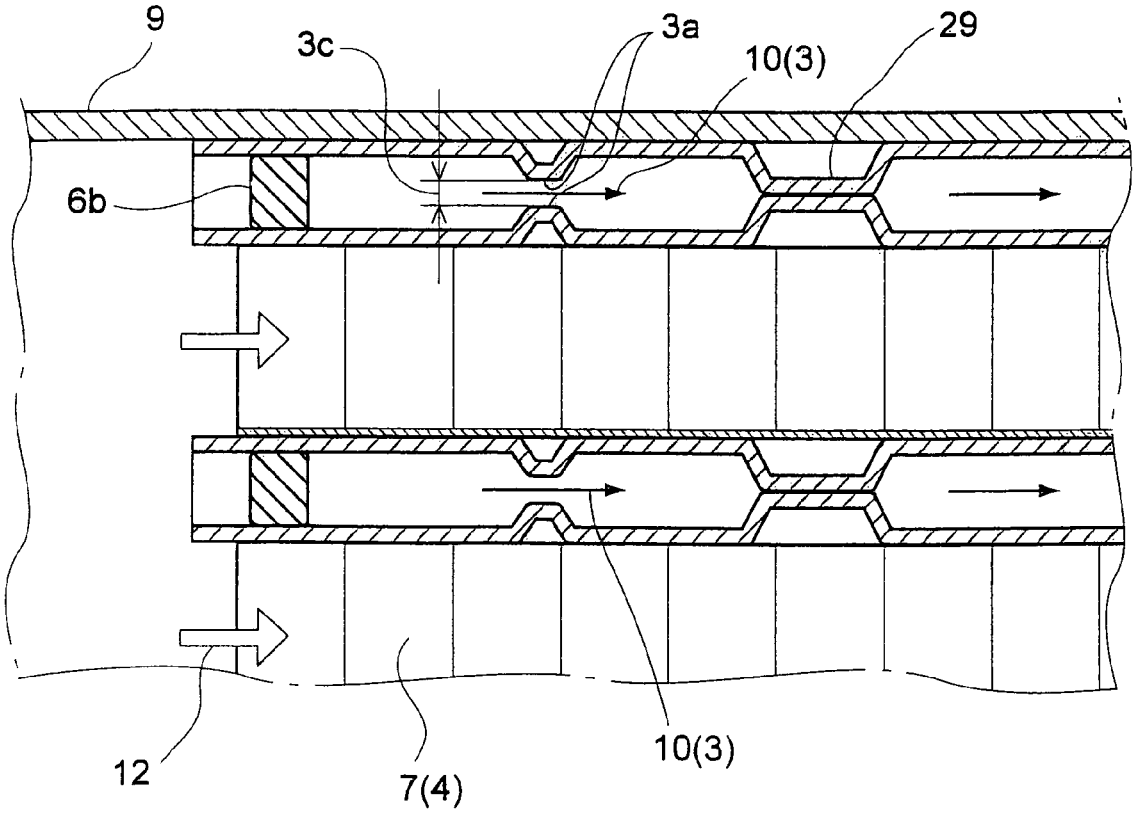
FIG. 5 is a schematic sectional view taken on line V-V of FIG. 2.
Figure 6:
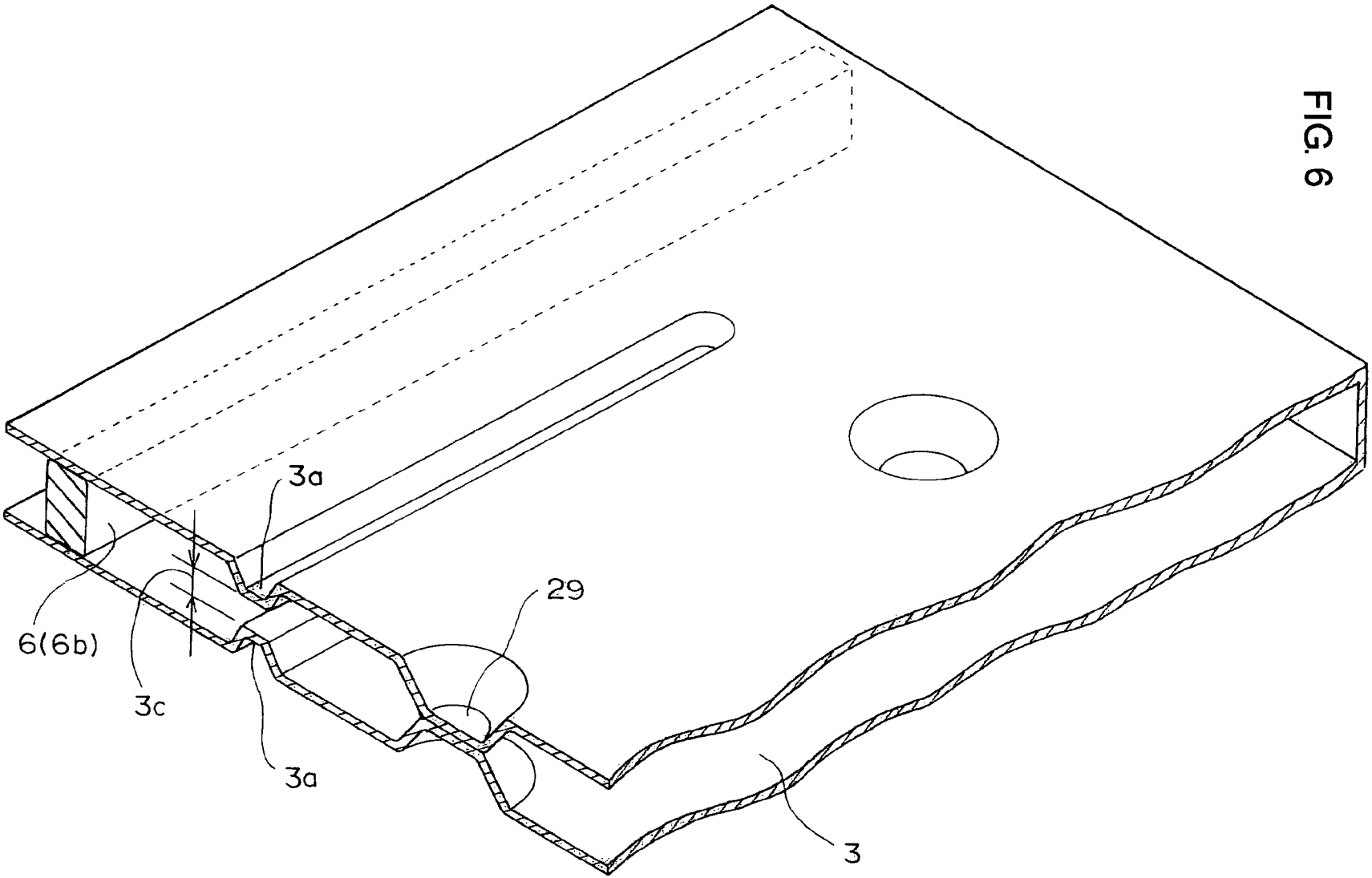
FIG. 6 is a schematic perspective view showing the cross section.
Figure 7A:
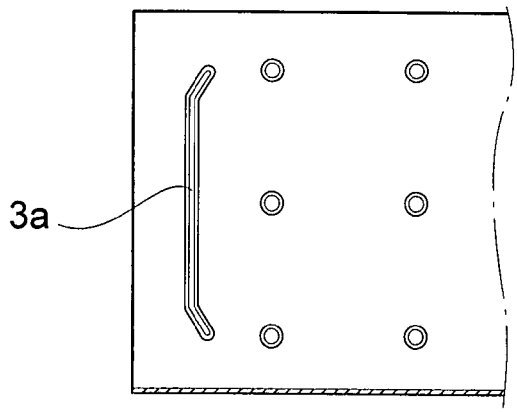
FIGS. 7(A) to 7(D) are plan views showing examples of each of projecting stripes 3*a* of a heat exchanger.
Figure 7B:
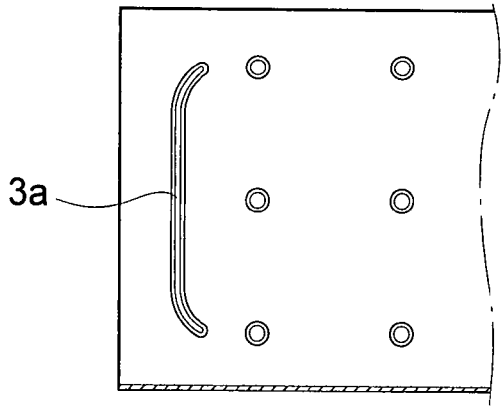
Figure 7C:
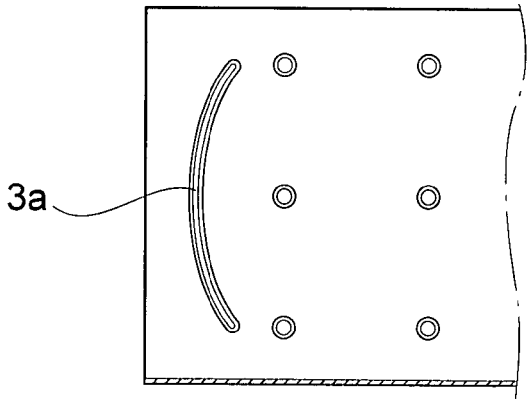
Figure 7D:
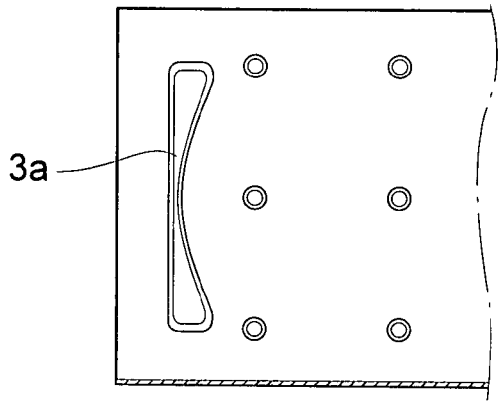

FIG. 1 is an exploded perspective view showing a substantial part of a heat exchanger according to the present invention, FIG. 2 is a sectional view showing the state of the assembling thereof, FIG. 3 is an exploded perspective view showing the whole heat exchanger, FIG. 4 is a perspective view showing the assembled state thereof, FIG. 5 is a schematic sectional view of a substantial part taken on line V-V of FIG. 2, and FIG. 6 is a perspective view thereof.

The heat exchanger has a core body 5, a large number of fins 7, a casing 9, a pair of header end lids 16 and 17, and a pair of slit blocks 6 as shown in FIG. 3.

The core body 5, as shown in FIG. 1: is configured by turning up and bending a strip-shaped metal plate in a fanfold manner and forming turned-up end edges 1 and 2 alternately at one end and then the other end of a rectangular planar portion 1*a*; and has flat first flow channels 3 and second flow channels 4 alternately in the thickness direction of the metal plate. In the example, the space of each of the first flow channels 3 is formed so as to be smaller than that of each of the second flow channels 4. It goes without saying that the spaces of both the channels may be identical or reversed.

Here, a large number of dimples 29 are protrusively formed on the strip-shaped metal plate on the sides of the first flow channels 3. In the example, the tips of opposing dimples 29 touch each other and thereby the space of each of the first flow channels 3 is kept constant. Comb teeth 6*b* of the slit blocks 6 are fitted into the first flow channels 3 at both the ends of the turned-up end edges 1 and the fitted portions are brazed and fixed in an integrated manner.

Further, projecting stripes 3*a* protrude in a pair in each of the first flow channels 3 in proximity to and in parallel with each of the slit blocks 6. The projecting stripes 3*a* face each other and gaps 3*c* are formed between the projecting stripes 3*a* as shown in FIGS. 5 and 6. The projecting stripes 3*a* are formed in all the first flow channels 3 and exist at both the ends of each of the first flow channels 3 in the longitudinal direction thereof as shown in FIG. 3.

Then, the projecting stripes 3*a* are formed so that the length thereof is smaller than the width of the core body 5 and placed at intermediate positions of the core body 5 in the width direction thereof. Further, the projecting stripes 3*a* are located at positions facing the ports 11 for cooling water 10 as shown in FIG. 2.

Then, it is designed so that the cooling water 10 flowing in from a port 11 is introduced to the projecting stripes 3*a* and reaches the vicinity of the turned-up end edges 1. Additionally, it is configured so that the cooling water 10 flows on the each part of the projecting stripes 3*a* also in the width direction as shown with the arrows (FIG. 2) through the gaps 3*c* between the opposing projecting stripes 3*a*, as shown in FIG. 5. As a result, the portions where the cooling water 10 stagnates disappear, the cooling water 10 flows uniformly in each part of the first flow channels 3, and the portions where the cooling water 10 boils disappear. Similar functions are carried out also on the side of the exit of the cooling water 10.

Each of the slit blocks 6 comprises a comb-shaped member 6*a* in this example. In the comb-shaped member 6*a*, a tooth root 6*c* intersects with comb teeth 6*b* at right angles (FIG. 1).

Next, fins 7 are interposed into each of the second flow channels 4 as shown in FIG. 1. Here, although FIG. 1 is shown in the state where the first flow channel 3 on the top is lifted upward in order to facilitate visualization of the fins 7, in reality the bottom side of the uppermost first flow channel 3 touches the fin 7 on the top. The fins 7: are formed by bending a metal plate into a waveform in a transverse sectional direction; and curve also along the mountain ridges and valleys thereof in the longitudinal direction, and thereby the agitation effect of a fluid flowing in the second flow channels 4 is enhanced.

A core 8 is composed of an assembly comprising the core body 5, the slit blocks 6, and the fins 7. Then it is also possible to insert slit fins, offset fins, or louver fins, those being not shown in the figures, in place of the fins 7 into the second flow channels 4.

Next, a casing 9 fitted to the outer circumference of the core 8: is formed into the shape of a tube the cross section of which is a rectangle the length of which is longer than that of the core 8; and has a pair of header sections 31 (refer to FIG. 2) on the outside of both the ends of the core 8. In this example, the casing 9 comprises a U-shaped member 9*a* and a lid 9*b* as shown in FIGS. 3 and 4.

The inner circumference of the U-shaped member 9*a* touches the upper and lower faces and one of the side faces of the core body 5 and blocks the communication between adjacent turned-up end edges 1 in the core body 5. The lid 9*b* closes: the opening side of the U-shaped member 9*a*; also the other side of the core body 5; and the openings 3*b* between the adjacent turned-up end edges 2. The U-shaped member 9*a*: is made of a nickel steel having high thermal resistance and high corrosion resistance, a stainless steel, or the like; and prevents damages caused by a high temperature exhaust gas as the fluid to be cooled 12 flowing in the interior.

In contrast, the lid 9*b* may be a material inferior to the U-shaped member 9*a* in thermal resistance and corrosion resistance because the cooling water 10 flows along the inner surface thereof. In general, a stainless steel that is inferior in thermal resistance and corrosion resistance has formability better than a material having high thermal resistance and high corrosion resistance and the material is less expensive. In the present example, as shown in FIG. 3, a pair of small tanks 28 is protrusively formed by press forming at both the end portions on the outside of the lid 9*b*, ports 11 open there respectively, and pipes 26 are connected to the ports 11. If a stainless steel that is somewhat inferior in thermal resistance and corrosion resistance is used, the small tanks 28 can be processed easily.

Here, the end edges of both the sidewalls of the U-shaped member 9*a* are fitted into fitting edge portions 15 (FIG. 1) turned up and formed at both the upper and lower ends of the core body 5. Then L-shaped portions at both the upper and lower ends of the lid 9*b* are fitted to the outsides of the fitting edge portions 15.

Thus, the reliability of brazing at connections between the lid 9*b*, the U-shaped member 9*a*, and the core body 5 can be improved.

Next, opening ends of header sections 31 at both the ends of the casing 9 in the longitudinal direction are closed with a pair of header end lids 16 and 17 made of a highly thermal resistant and corrosion resistant material and flanges 25 are fitted further outside. Each of the header end lids 16 and 17 is bulged outward into the shape of a pan in the present example and a port through which the fluid to be cooled 12 flows opens in the center thereof. Further, extension parts 16*a* and 17*a* are integrally formed on one side of the header end lids 16 and 17 respectively in an extended manner and the extension parts 16*a* and 17*a* cover the inner surface of both the ends (one end is omitted) of the lid 9*b* as shown in FIG. 2.

A brazing metal is coated or disposed on each of the contact portions in such a heat exchanger and the whole body in the assembled state as shown in FIGS. 2 and 4 is integrally brazed and fixed in a high temperature furnace.

Then as shown in FIGS. 2 and 4, the cooling water 10 is supplied to the side of the first flow channels 3 and the fluid to be cooled 12 is supplied to the side of the second flow channels 4.

The cooling water 10 is supplied to each of the first flow channels 3 through one of the pipes 26 and one of the small tanks 28, those being formed protrusively on one side of the casing 9, as shown in FIG. 2. On that occasion, a pair of upper and lower projecting stripes 3*a* is protrusively formed at the positions opposing the small tank 28 in the first flow channel 3*a*, and hence the cooling water 10 is guided by the projecting stripes 3*a*, flows between the projecting stripes 3*a* and comb teeth 6*b*, and reaches the vicinity of the turned-up end edges 1. Moreover, a part of the cooling water 10 flowing between the projecting stripes 3*a* and comb teeth 6*b*: passes through the gaps 3*c* between a pair of upper and lower projecting stripes 3*a*; and flows evenly at each part of the first flow channels 3 in the width direction as shown with the arrows.

Here, in order for the cooling water 10 to flow evenly at each part of the first flow channels 3 in the width direction with a high degree of accuracy, it is required to: decide various conditions through flow tests of the cooling water 10; and then adopt an optimum shape of the projecting stripes 3*a* and an optimum height of the gaps 3*c* between the respective projecting stripes 3*a*. As the shape of each of the projecting stripes 3*a* in a plan view, any one of the patterns (A) to (D) shown in FIG. 7 can be adopted for example. The pattern (A) is the case where both the end portions of each of the projecting stripes 3*a* are bent into an L-shape, and the pattern (B) is the case where both the end portions of each of the projecting stripes 3*a* are curved. Then the pattern (C) is the case where the whole length of each of the projecting stripes 3*a* is arched, and the pattern (D) is the case where the width of each of the projecting stripes 3*a* varies in the longitudinal direction.

Figure 8A:
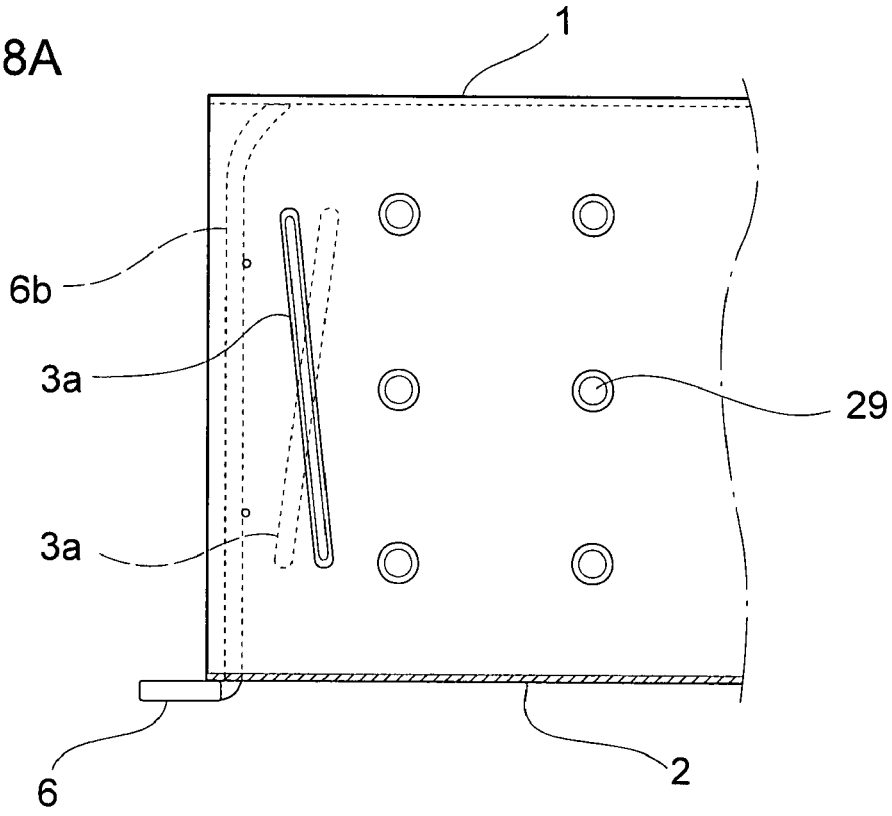
FIGS. 8(A) and 8(B) are a plan view showing another example of each of the projecting stripes 3*a* and a view illustrating the production process.
Figure 8B:
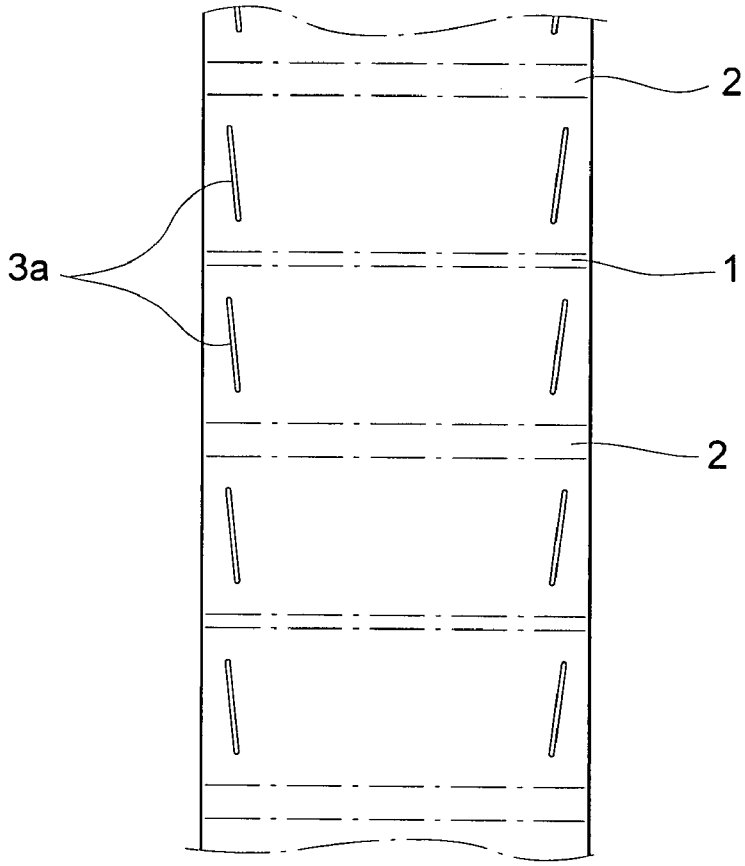
Figure 9A:
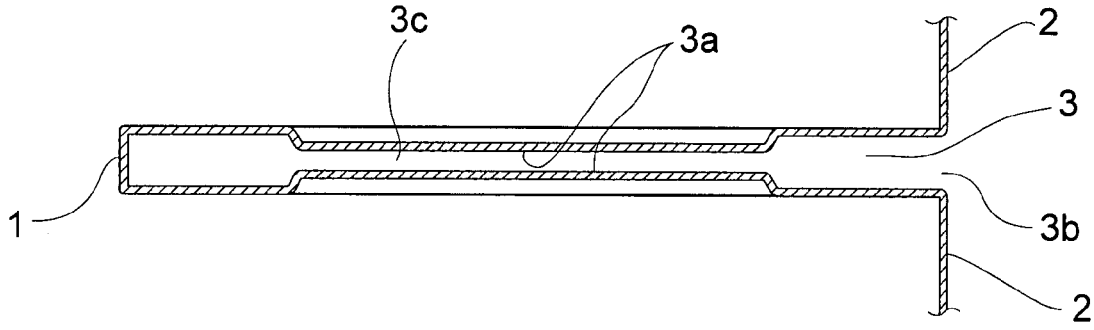
FIGS. 9(A) to 9(C) are sectional views showing examples of various kinds of gaps 3*c* between the projecting stripes 3*a*.
Figure 9B:
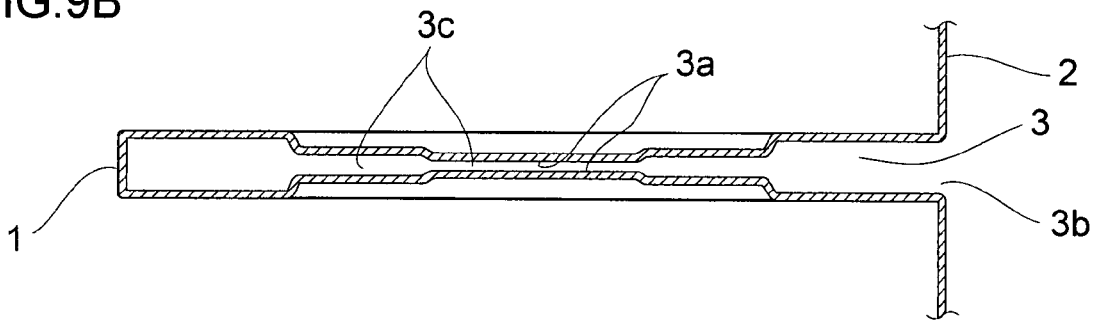
Figure 9C:
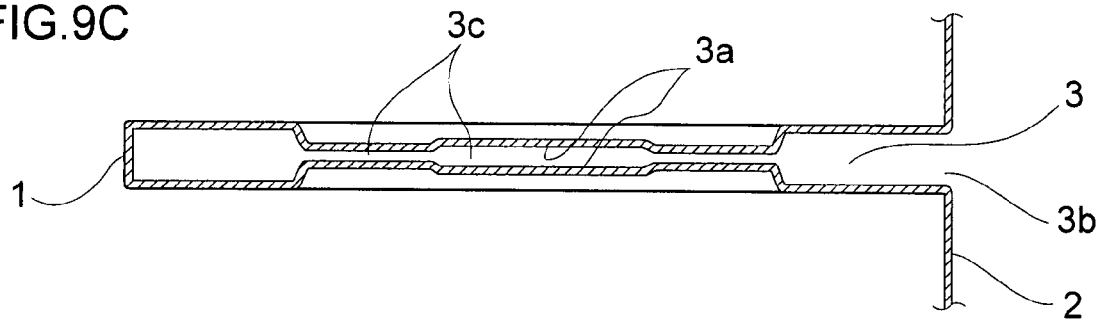

Further, as shown in FIG. 8(A), a pair of upper and lower projecting stripes 3*a* may be configured so as to intersect with each other in a plan view. On this occasion, the projecting stripes 3*a* are formed on a metal plate in a developed state beforehand so that the projecting stripes 3*a* may lean outward as shown in FIG. 8(B) and the metal plate is formed in a fanfold manner at the turned-up end edges 1 and 2.

Here, in FIG. 8(A), the tip of each of the comb teeth 6*b* of the slit blocks 6 is curved and the cooling water 10 flows smoothly along the curved tip. Thereby, the stagnation of the cooling water 10 can be avoided further effectively.

The cooling water 10 flowing in each of the first flow channels 3 in the longitudinal direction goes toward the other pipe 26 and flows out to the exterior through the pipe 26. On this occasion, a pair of upper and lower projecting stripes 3*a* exists at the exit side too, and thus the cooling water 10 is guided by the projecting stripes 3*a* and smoothly flows without yielding stagnated portions.

Next, for example, the fluid to be cooled 12 comprising a high temperature exhaust gas is supplied to each of the second flow channels 4 from the opening of the header end lid 16 through one of the openings 13 of the casing 9.

The invention claimed is:

1. A heat exchanger wherein:

a core body is configured by turning up and bending a strip-shaped metal plate in a fanfold manner and forming turned-up end edges alternately at one end and then the other end of a rectangular planar portion, and has flat first flow channels and second flow channels alternately in the thickness direction of the metal plate;

the first flow channels of the core body are blocked with slit blocks comprising long boards or bars at both the ends of each of said turned-up end edges, flat openings are formed only on one side, fins are interposed in said second flow channels, and thus a core is formed;

the outer circumference of the core body is fitted in a tubular casing and thereby communication between adjacent turned-up end edges is blocked;

a pair of ports for cooling water is formed at both the end portions of the casing on the side facing the side of said openings of said first flow channels;

projecting stripes are bent and formed on the opposing planes in each of said first flow channels in proximity to and along said slit blocks at the positions opposing the ports, and gaps are formed between the respective projecting stripes;

said cooling water is introduced into the respective first flow channels from said ports, and a part of said introduced cooling water is guided by said projecting stripes and passes through between the pair of opposing projecting stripes; and a fluid to be cooled is introduced from one cylindrical opening of said casing to the other opening through the respective second flow channels.

2. The heat exchanger according to claim 1, configured so that the gaps between said projecting stripes may vary along the longitudinal direction.

3. The heat exchanger according to claim 2, wherein the gaps at intermediate portions of the projecting stripes in the longitudinal direction thereof are formed so as to be larger or smaller than the gaps at both the ends.

4. The heat exchanger according to claim 1, wherein the pair of opposing projecting stripes is formed so as to intersect with each other in a plan view.

5. The heat exchanger according to any one of claims 1 to 4, wherein at least both the ends of the projecting stripes in the longitudinal direction thereof curve to the side of the center of each of the first flow channels.

6. The heat exchanger according to any one of claims 1 to 4, configured so that the width of each of said projecting stripes varies along the longitudinal direction thereof.

* * * * *